US010164353B2

(12) United States Patent
Miki et al.

(10) Patent No.: US 10,164,353 B2
(45) Date of Patent: Dec. 25, 2018

(54) WATERPROOF CONNECTOR

(71) Applicant: YOKOWO CO., LTD., Kita-ku, Tokyo (JP)

(72) Inventors: Katsuo Miki, Tomioka (JP); Shingo Orikasa, Tokyo (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 15/552,919

(22) PCT Filed: Feb. 17, 2016

(86) PCT No.: PCT/JP2016/054555
§ 371 (c)(1),
(2) Date: Aug. 23, 2017

(87) PCT Pub. No.: WO2016/136554
PCT Pub. Date: Sep. 1, 2016

(65) Prior Publication Data

US 2018/0034173 A1 Feb. 1, 2018

(30) Foreign Application Priority Data

Feb. 23, 2015 (JP) ..... 2015-033023

(51) Int. Cl.
*H01R 9/22* (2006.01)
*H01R 13/52* (2006.01)

(52) U.S. Cl.
CPC ..... *H01R 9/223* (2013.01); *H01R 13/52* (2013.01); *H01R 13/521* (2013.01)

(58) Field of Classification Search
CPC .. H01R 9/223; H01R 13/443; H01R 13/5205; H01R 13/506; H01R 13/5202; H01R 13/5208; H01R 43/20; H01R 13/56
(Continued)

(56) References Cited

U.S. PATENT DOCUMENTS 4,643,506 A * 2/1987 Kobler ..... H01R 13/5205 439/271
6,036,541 A * 3/2000 Koumatsu ..... F16J 15/062 215/355

(Continued)

FOREIGN PATENT DOCUMENTS

JP H07-267020 A 10/1995
JP 2001-185280 A 7/2001

(Continued)

OTHER PUBLICATIONS

International Search Report dated Apr. 26, 2016, for corresponding International Patent Application No PCT/JP2016/054555.

(Continued)

*Primary Examiner* — Edwin A. Leon
(74) *Attorney, Agent, or Firm* — Morgan, Lewis & Bockius LLP

(57) ABSTRACT

To simplify an assembling process and reduce a height while keeping a reliable waterproof structure by improving structures of a housing and an elastic body. Provided are an insulative housing 31, an insulative elastic body 40 which is held by the housing 31, and terminal pins 50 which penetrate through the elastic body 40 and are held by the housing 31. The insulative elastic body 40 has an outside elastic portion 41 and inside elastic portions 42 into which the insulative elastic body 40 is partitioned by the housing 31 and link portions 45 which link the outside elastic portion 41 to the inside elastic portions 42. The housing 31 is provided with wall portions 35 with which the inside elastic portions 42 through which the respective terminal pins 50 penetrate are in contact in a compressed state.

16 Claims, 8 Drawing Sheets

(58) Field of Classification Search
USPC ..... 439/519, 587
See application file for complete search history.

(56) References Cited

U.S. PATENT DOCUMENTS

| | | | | |
|---|---|---|---|---|
| 6,152,752 | A * | 11/2000 | Fukuda | H01R 13/506 439/274 |
| 6,390,848 | B1 * | 5/2002 | Murakami | H01R 13/443 439/148 |
| 9,022,804 | B2 * | 5/2015 | Kobayashi | H01R 13/5205 439/587 |

FOREIGN PATENT DOCUMENTS

| | | | |
|---|---|---|---|
| JP | 2007-323300 | A | 12/2007 |
| JP | 2014-135184 | A | 7/2014 |
| JP | 2014-216826 | A | 11/2014 |

OTHER PUBLICATIONS

Written Opinion of the International Searching Authority dated Apr. 26, 2016, for corresponding International Patent Application No. PCT/JP2016/054555.

* cited by examiner

WATERPROOF CONNECTOR

TECHNICAL FIELD

The present invention relates to a waterproof connector that is used as an I/O connector or the like of information terminals such as notebook PCs, tablet terminals, wearable terminals, and cell phones, POS terminals, etc.

BACKGROUND ART

FIGS. 10(A)-10(D) show an example conventional waterproof connector. The waterproof connector 10 shown in FIGS. 10(A)-10(D) has a structure that a receiving pin (terminal pin) 3 is inserted in a resin housing 4 using an inside rubber member 1 and an outside rubber member 2 which act as watertight sealing. An assembling procedure will be described below in order. First, an inside rubber member 1, an outside rubber member 2, a receiving pin 3, and a resin housing 4 are prepared as shown in FIG. 10(A), the receiving pin 3 is fitted into the inside rubber member 1 as shown in FIG. 10(B), and the resulting structure is fitted into the resin housing 4 as shown in FIG. 10(C). Then, as shown in FIG. 10(D), the resin housing 4 is fitted into the outside rubber member 2. Watertight sealing between the receiving pin 3 and the housing 4 is established by the inside rubber member 1 that is in a compressed state, and watertight sealing between the housing 4 and an outside mounting body 15 of an incorporation target apparatus (e.g., any of various terminals) is established by the outside rubber member 2 that is in a compressed state being sandwiched between the housing 4 and the outside mounting body 15.

The assembling of the waterproof connector 10 shown in FIGS. 10(A)-10(D) requires three manufacturing steps which are too many. Furthermore, to allow the inside rubber member 1 to move to a prescribed position smoothly in fitting the inside rubber member 1 into the resin housing 4, it is necessary that the inner circumferential surface of the housing 4 be formed with a guide taper 4*a* and the height dimension of the housing 4 be set large.

FIG. 11 shows another example conventional waterproof connector. The waterproof connector 20 shown in FIG. 11 has a structure that a terminal member 21 and a resin housing 22 are insert-molded together and the resulting structure is fitted in an outside rubber member 23. Watertight sealing between the terminal member 21 and the resin housing 22 is established with a prerequisite that the terminal member 21 and the resin housing 22 are in close contact with each other because of the insert molding. Watertight sealing between the housing 22 and an outside mounting body 15 of an incorporation target apparatus is established by the outside rubber member 23 that is in a compressed state being sandwiched between the housing 22 and the outside mounting body 15.

Since the terminal member 21 and the resin housing 22 are insert-molded together, the waterproof connector 20 in FIG. 11 has only a small number of structure-related restrictions when it is assembled and can be made low in height. However, as for its waterproof performance relating to the insert molding, the closeness of the contact between the terminal member 21 and the resin housing 22 is uncertain because it depends on their thermal deformations (e.g., ones caused by soldering). To avoid such uncertainty, a special bonding technique is necessary. Furthermore, insertion into the outside rubber member 23 needs to be done as a separate step.

PRIOR ART DOCUMENTS

Patent Documents

Patent document 1: Japanese Unexamined Patent Application Publication No. 2014-216826

Patent document 2: Japanese Unexamined Patent Application Publication No. 2007-323300

SUMMARY OF THE INVENTION

Problems to be Solved by the Invention

As described above, the conventional example shown in FIGS. 10(A)-10(D) has the problems that the number of manufacturing steps is large and it is difficult to reduce the height of the resin housing. Furthermore, the conventional example shown in FIG. 11 has the problem that the reliability of the closeness of the contact between the terminal member and the resin housing is insufficient.

The present invention has been made in view of the above circumstances, and an object of the present invention is therefore to provide a waterproof connector whose assembling process can be simplified and height can be reduced while its waterproof structure is kept reliable, by improving the structures of a housing and an elastic body.

Means for Solving the Problems

An aspect according to the present invention is a waterproof connector. The waterproof connector includes an insulative housing, an insulative elastic body which is held by the housing, and a terminal pin which penetrates through the insulative elastic body and are held by the housing, the insulative elastic body has an inside elastic portion and an outside elastic portion are partitioned by the housing to each other, and a link portion which links the outside elastic portion and the inside elastic portion to each other; and the housing is provided with a wall portion with which the inside elastic portions through which the terminal pin penetrates is in contact in a compressed state.

In the aspect, the wall portion may be formed so as to surround the entire circumference of the terminal pin.

In the aspect, the housing may have a tunnel in a portion where the insulative elastic body is partitioned into the inside elastic portion and the outside elastic portion, and the link portion be formed in the tunnel.

The housing may have a base portion which supports a bottom surface of the insulative elastic body and a terminal holding portion which projects from a top surface of the base portion and partitions the insulative elastic body into the inside elastic portion and the outside elastic portion;

the terminal holding portion may be formed with a recess having a portion which is fitted with a head of the terminal pin and the wall portion, for each of a plurality of terminal pins; and the tunnel may allow an outer circumferential surface of the terminal holding portion and the recess to communicate with each other.

The base portion may have a through-hole which an insertion end portion of the terminal pins fits, and a groove extending from the through-hole to a side surface of the base portion is formed on a bottom surface of the base portion.

Any combinations of the above constituent elements and methods, systems, etc. obtained by converting any of the above expressions of the invention are also effective as other aspects of the present invention.

Advantages of the Invention

According to the waterproof connectors of the present invention, the assembling process can be simplified and the height can be reduced while the waterproof structure is kept reliable by improving the structures of the insulative housing and the insulative elastic body.

BRIEF DESCRIPTION OF THE DRAWINGS

FIG. 1(A) is a plan view, FIG. 1(B) is a front view, and FIG. 1(C) is a side view.

FIG. 10(A) is an exploded view, FIG. 10(B) is an exploded view showing a state that a terminal pin is fitted in an inside rubber member, FIG. 10(C) is an exploded view showing a state that the structure that the terminal pin is fitted in the inside rubber member is fitted in a housing, and FIG. 10(D) is a sectional view showing an assembling-completed state.

MODES FOR CARRYING OUT THE INVENTION

Figure 1A:
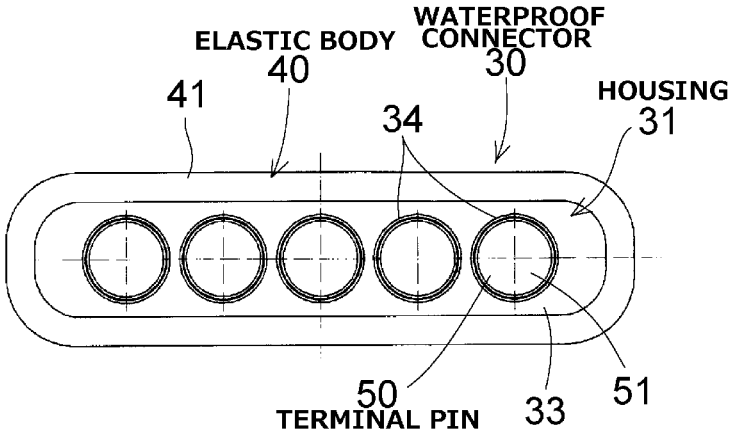
FIGS. 1(A), 1(B), and 1(C) show an embodiment of a waterproof connector according to the present invention.
Figure 1B:
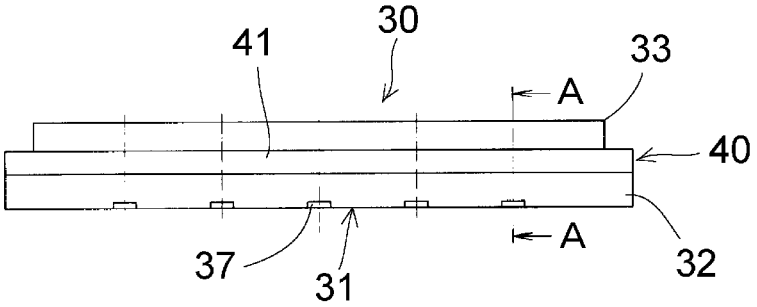
Figure 1C:
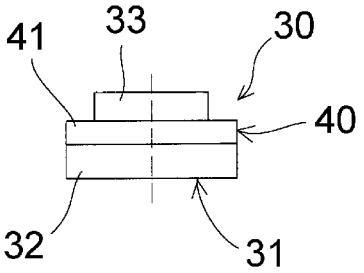

A preferred embodiment of the present invention will be described in detail with reference to the drawings. Each set of identical or equivalent constituent elements, members, pieces of processing, etc. is denoted with the same reference numerals, and redundant descriptions are appropriately omitted. Moreover, the invention is not limited to the embodiment, and the embodiment is only an example of the invention, and all features and combinations of the features which are described in the embodiment are not necessarily essential to the invention.

Figure 2:
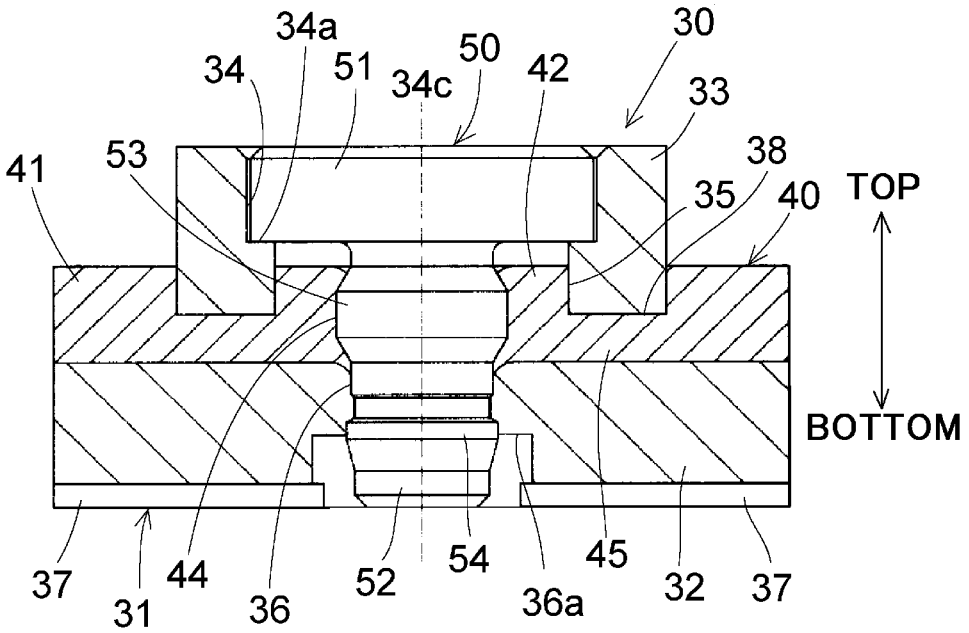
FIG. 2 is an enlarged sectional view taken along line A-A in FIG. 1.
Figure 3:
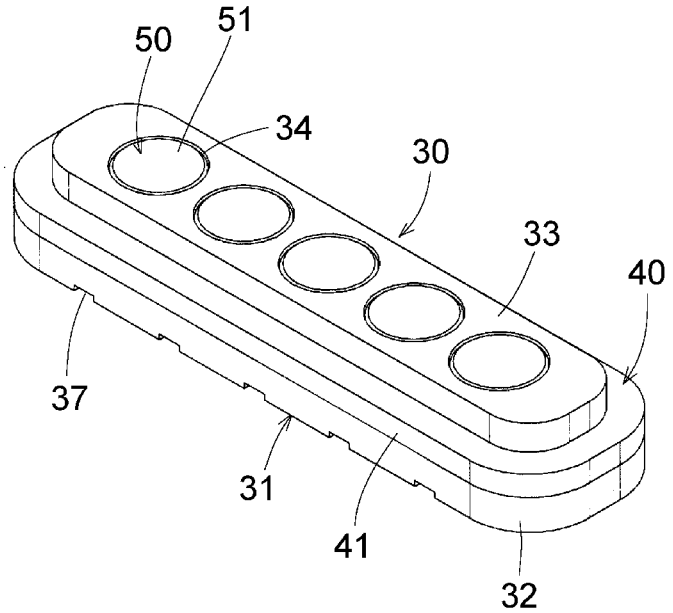
FIG. 3 is a perspective view of the embodiment as viewed from above.
Figure 4:
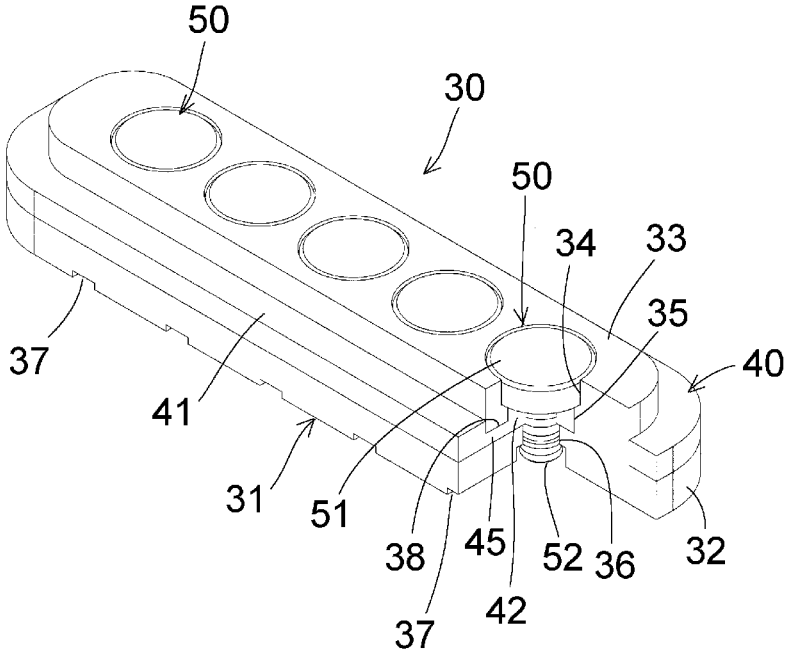
FIG. 4 is a perspective view in which a portion in FIG. 3 is cut away to show cross sections.

As shown in FIGS. 1(A)-6, a waterproof connector 30 is equipped with an insulative housing 31 made of a hard resin (plastic), an insulative elastic body 40 which is made of a rubber and held by the housing 31, and metal conductor terminal pins (receiving pins) 50 which penetrate through the elastic body 40 and are held by the housing 31. The top-bottom direction is defined as shown in FIG. 2.

The terminal pins 50 are members to be brought into contact with and thereby electrically connected to respective connection counterpart contactors. Each terminal pin 50 has a disc-shaped head 51 and a cylindrical portion 52 which is smaller in diameter than the disc-shaped head 51, and is formed with a waterproof ring-shaped projection 53 for enhancement of waterproofness and a coming-off preventive ring-shaped projection 54 as outer circumferential portions of the cylindrical portion 52. The coming-off preventive ring-shaped projection 54 is located closer to the tip (bottom end) of the cylindrical portion 52 than the waterproof ring-shaped projection 53 is.

The insulative housing 31 has a base portion 32 which supports the bottom surface of the insulative elastic body 40 and a terminal holding portion 33 which projects from part of the top surface of the base portion 32. The top surface of the base portion 32 supports the bottom surface of the elastic body 40 and extends outward with respect to the outer circumferential surface of the terminal holding portion 33. The terminal holding portion 33 holds the terminal pins 50 so that they extend in the top-bottom direction, and partitions the insulative elastic body 40 into an outside elastic portion 41 and inside elastic portions 42. The terminal holding portion 33 is formed with stepped cylindrical recesses 34 having portions that are fitted with the heads 51 of the plural (in the illustrated example, five) terminal pins 50, respectively. The center axes 34*c* of the stepped cylindrical recesses 34 are perpendicular to the top surface of the base portion 32 (i.e., extend in the top-bottom direction). Each stepped cylindrical recess 34 has a step portion 34*a* which supports the bottom surface of the head 51 and an inner circumferential wall portion 35 which surrounds the cylindrical portion 52 of the terminal pin 50 under the step portion 34*a*. The inner circumferential wall portion 35 surrounds the entire circumference of the cylindrical portion 52. The terminal holding portion 33 is formed with tunnels 38 which extend in radial directions of the recesses 34 and allow the recesses 34 to communicate with the space adjoining the outer circumferential surface of the terminal holding portion 33. The recesses 34 and the tunnels 38 are bounded by the top surface of the base portion 32 at their bottoms, and the tunnels 38 are directed perpendicularly to the longitudinal direction of the base portion 32. The base portion 32 is formed with through-holes 36 which communicate with and are concentric with the respective recesses 34 and into which the cylindrical portions 52 of the terminal pins 50 can be press-fitted, respectively (i.e., the diameter of the through-holes 36 is slightly smaller than the outer diameter of the press-fitting portions of the cylindrical portions 52).

Figure 5:
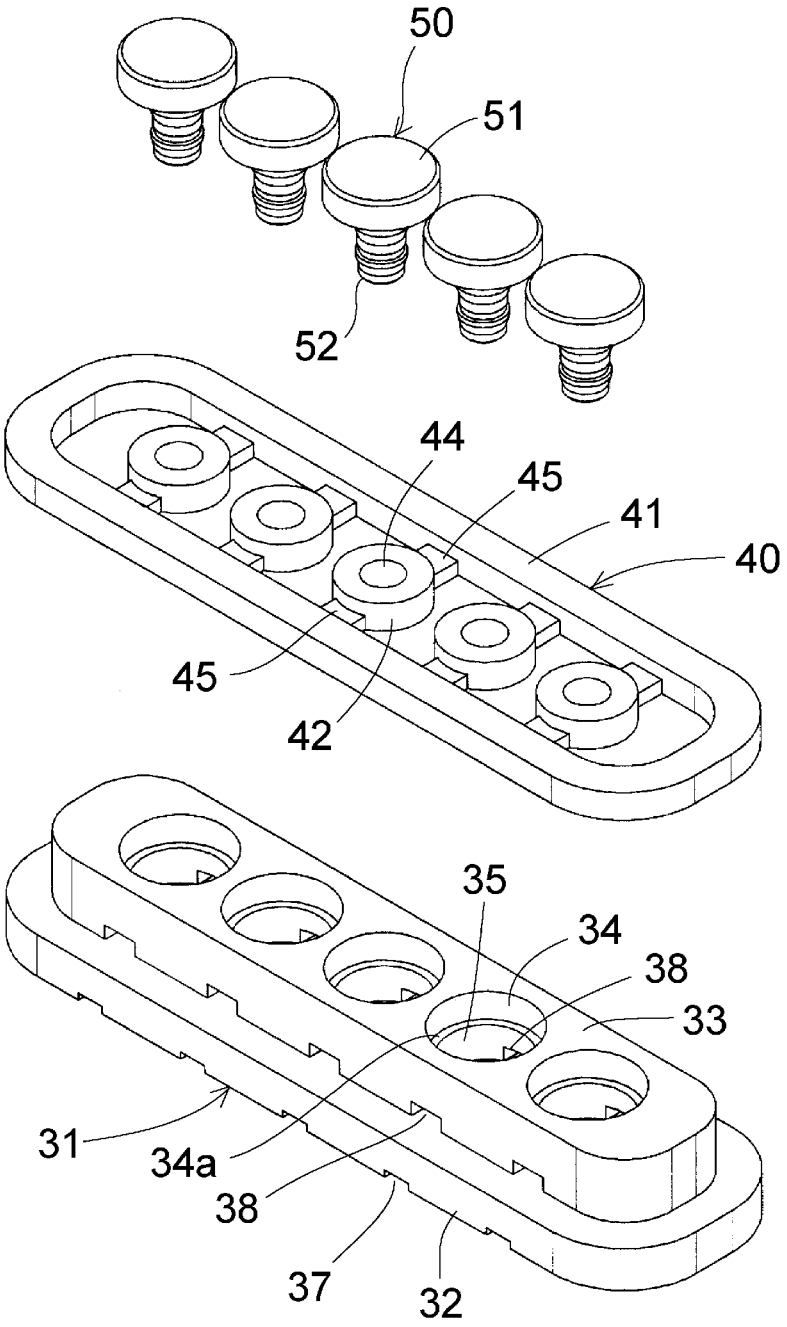
FIG. 5 is a separated view showing shapes of individual members of the embodiment.
Figure 6:
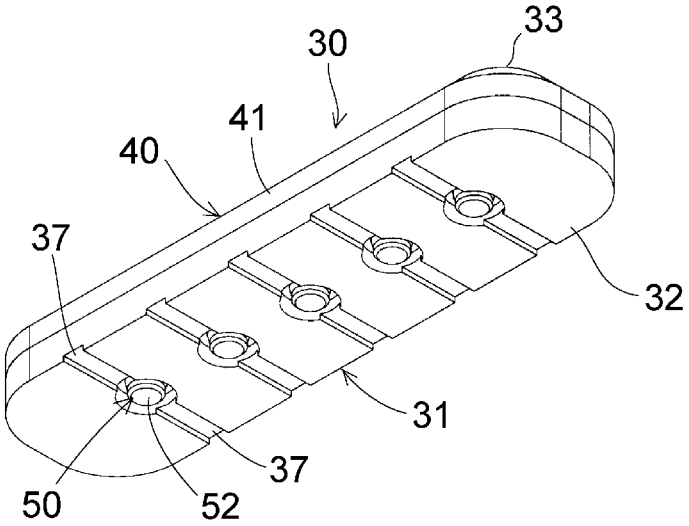
FIG. 6 is a perspective view of the embodiment as viewed from below.
Figure 7:
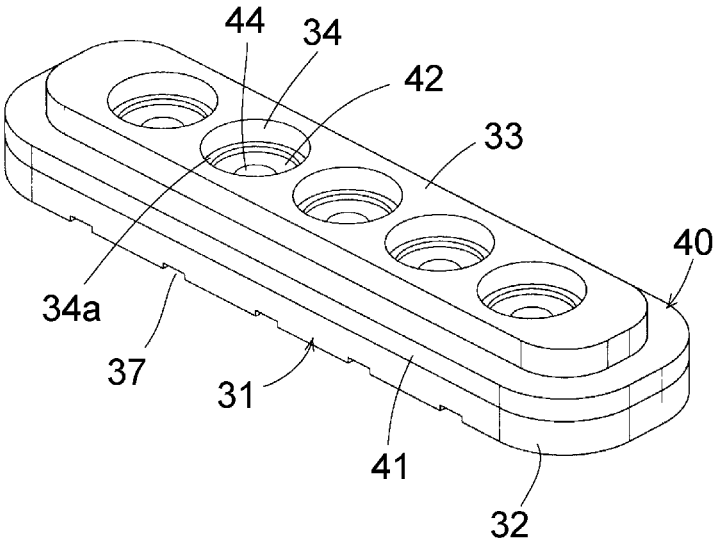
FIG. 7 is a perspective view showing a state of the embodiment before insertion of terminal pins.
Figure 8:
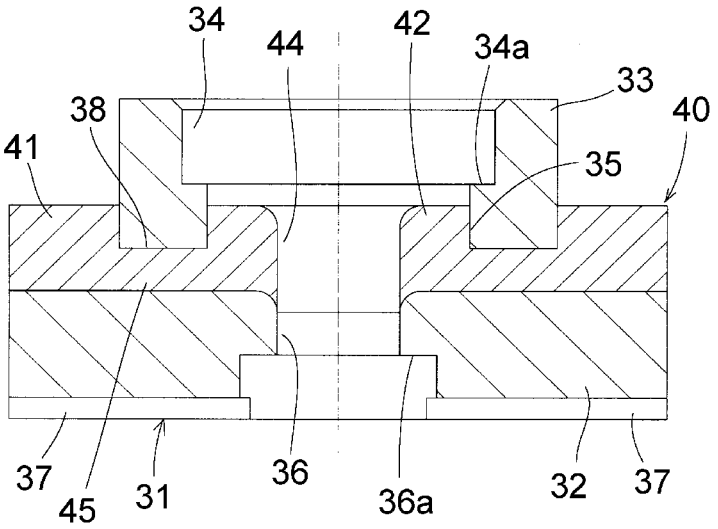
FIG. 8 is an enlarged side sectional view showing a state of the embodiment before insertion of the terminal pins.

The insulative elastic body 40 is formed integrally with the insulative housing 31 by what is called double molding: an elastic body 40 having a desired shape is molded in such a manner that after an insulative housing 31 is resin-molded in a die, a space for formation of the elastic body 40 is formed by moving a part of the die and an elastic body material is injected. As shown in FIG. 5 and FIGS. 7 and 8 which show a state before insertion of the terminal pins 50, the elastic body 40 has the outside elastic portion 41 which surrounds the outer circumferential surface of the terminal holding portion 33, link portions 45 which are formed as a result of entrance of the elastic body material into the tunnels 38, and the inside elastic portions 42 which are formed a result of entrance of the elastic body material into an inside of the cylindrical recesses 34 via the tunnels 38. FIG. 5 is a separated view for easily understanding of the shapes of the individual members; although the housing 31 and the elastic body 40 are separated in FIG. 5, in practice, they cannot be formed independently of each other so as to be separated from each other. The inside elastic portions 42 are formed with through-holes 44 which are concentric with the respective stepped cylindrical recesses 34 and into which the cylindrical portions 52 of the terminal pins 50 can be press-fitted, respectively (i.e., the diameter of the through-holes 44 is slightly smaller than the outer diameter of the press-fitting portions of the cylindrical portions 52). To facilitate press fitting of each terminal pin 50, a top opening portion of each through-hole 36 of the base portion 32 and a top opening portion of the through-hole 44 of each inside elastic portion 42 are tapered so as to become wider as the position goes upward. Each through-hole 36 is a stepped hole, and its bottom-side opening portion has a large diameter because of formation of a step portion 36*a*.

The bottom surface of the insulative housing 31 (i.e., the bottom surface of the base portion 32) is formed with grooves 37 which extend from the bottom-side opening portions of the through-holes 36 which are wider than insertion-side end portions of the terminal pins 50 (i.e., bottom end portions of the cylindrical portions 52) to side surfaces (outer circumferential surfaces) of the base portion 32. The grooves 37 eject, to the outside, gases that are generated when the terminal pins 50 are soldered to a board 60 (of an incorporation target apparatus such as an information terminal or a POS terminal) and thereby prevent the insulative housing 31 from lifting up from the board 60 (the soldering will be described later with reference to FIG. 9).

The waterproof connector 30 can be assembled by a single step by inserting (press-fitting) the cylindrical portions 52 of the terminal pins 50 into the through-holes 44 of the inside elastic portions 42 and the through-holes 36 of the base portion 32 after forming the insulative housing 31 and the insulative elastic body 40 in an integral manner as shown in FIGS. 7 and 8. After the insertion of the terminal pins 50, the heads 51 of the terminal pins 50 are fitted into the portions, above the step portions 34*a*, of the stepped cylindrical recesses 34 of the terminal holding portion 33 and, as shown in FIG. 2 etc., the waterproof ring-shaped projection 53 which are outer circumferential portions of the cylindrical portions 52 are fitted into the through-holes 44 of the inside elastic portions 42 and thereby compress the inside elastic portions 42 together with the inner circumferential wall portions 35. The inner circumferential wall portions 35 and the outer circumferential portions of the cylindrical portions 52 are kept in contact with the respective inside elastic portions 42 being compressed. In this manner, watertight sealing can be established between the terminal pins 50 and the respective inside elastic portions 42. The coming-off preventive ring-shaped projection 54 which are outer circumferential portions of the cylindrical portion 52 are engaged with the bottom-side step portions 36*a* of the through-holes 36, whereby the terminal pins 50 can be held by the base portion 32 so as not to come off.

Figure 9:
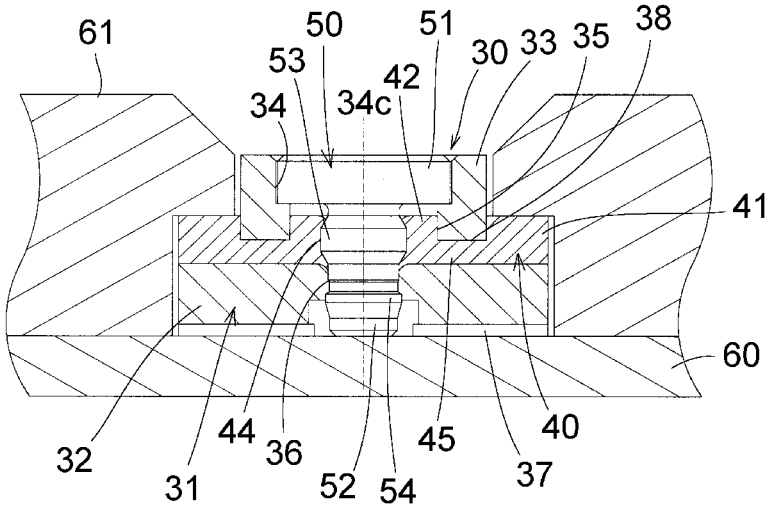
FIG. 9 is an enlarged side sectional view showing a state that the waterproof connector as the embodiment is incorporated in an incorporation target apparatus (any of various terminals).
Figure 10A:
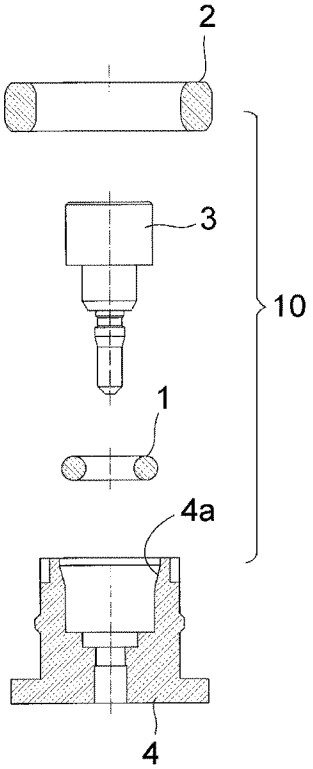
FIG.10(A) PRIOR ART
FIGS. 10(A)-10(D) show an example conventional waterproof connector.
Figure 10B:
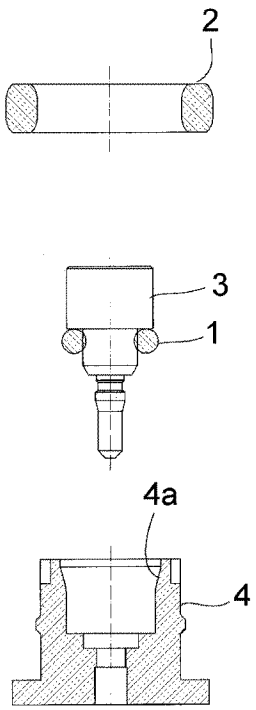
FIG.10(B) PRIOR ART
Figure 10C:
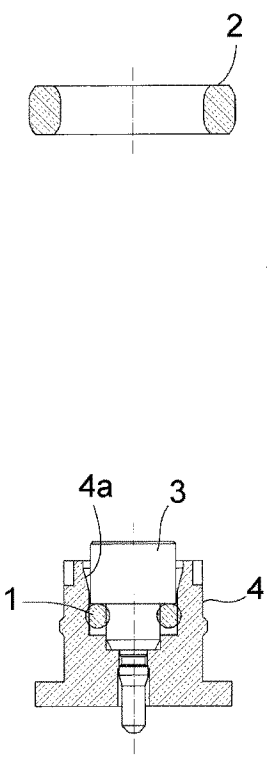
FIG.10(C) PRIOR ART
Figure 10D:
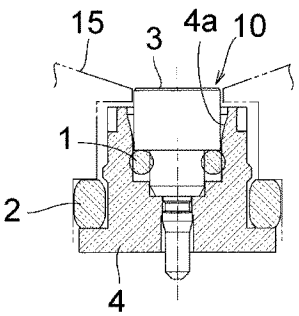
FIG.10(D) PRIOR ART

FIG. 9 shows a state that the waterproof connector 30 is attached to an incorporation target apparatus such as an information terminal or a POS terminal. The tip surfaces of the terminal pins 50 are fixed (soldered) to conductor surfaces of a board 60 of the apparatus (solder is not shown in the drawings). Furthermore, when the board 60 is fixed to an outside mounting body 61 by screws or the like, the laminated portion of the base portion 32 and the outside elastic portion 41 is held between and compressed by the board 60 and the outside mounting body 61, whereby watertight sealing is established between the outside elastic portion 41 and the outside mounting body 61. The outside mounting body 61 is an insulator made of a hard resin, for example. The heads 51 of the terminal pins 50 are exposed to the outside and brought into contact with and thereby electrically connected to respective connection counterpart contactors.

The embodiment may provide the following advantages:

(1) In the waterproof connector 30, the insulative housing 31 and the insulative elastic body 40 are molded so as to be integral with each other and the portions of the elastic body 40 constitute the inside elastic portions 42 which surround the cylindrical portions 52 of the terminal pins 50, respectively. With this structure, it is not necessary that the housing 31 be formed with tapers (see FIGS. 10(A)-10(D)) for guiding the terminal pins 50 when the terminal pins 50 are inserted into the housing 31. Therefore, it is possible to make the height of the housing 31 lower, that is, it is possible to provide the low-profile waterproof connector 30.

(2) Since the insulative housing 31 and the insulative elastic body 40 are molded so as to be integral with each other, a step of incorporating the elastic body 40 into the insulative housing 31 is not necessary and the assembling process is simplified accordingly.

(3) Since the housing 31 is provided with the outside elastic portion 41 and the inside elastic portions 42 in such a manner that they are connected together by the link portions 45 which go through the respective tunnels 38 of the housing 31, the outside elastic portion 41 and the inside elastic portions 42 do not come off the housing 31.

Figure 11:
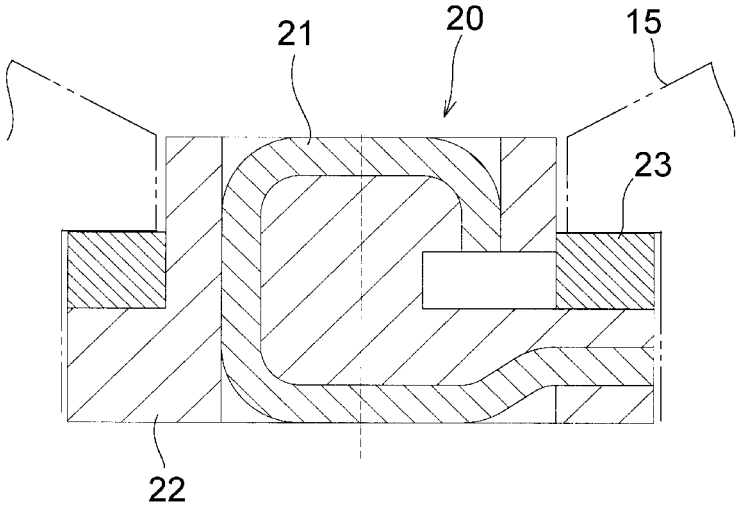
FIG.11 PRIOR ART
FIG. 11 is a sectional view of another example conventional waterproof connector.

(4) The inner circumferential wall portions 35 of the terminal holding portion 33 of the housing 31 are formed so as to surround the terminal pins 50 individually, and each terminal pin 50 can reliably be sealed watertightly by the inside elastic portion 42 which is surrounded and compressed by the inner circumferential wall portion 35. No consideration needs to be given to lowering of closeness of the contact or loss of contact due to thermal deformations, a problem that arises when the terminal member 21 and the resin housing 22 are insert-molded together in the conventional example shown in FIG. 11.

(5) The outside elastic portion 41 is placed on the top surface of the base portion 32 of the housing 31 so as to surround the entire circumference of the terminal holding portion 33, and a watertight sealing structure can be realized with the outside mounting body 61 of the incorporation target apparatus.

(6) Located at a medium height position in the height direction of the housing 31, the elastic body 40 is exposed neither in a top-side part, affecting its appearance, of the incorporation target apparatus (i.e., the outside elastic portion 41 is covered with the outside mounting body 61 of the incorporation target apparatus) nor in a bottom-side part, affecting the resistance to soldering heat at the time of mounting on the board 60, of the incorporation target apparatus. Thus, deterioration of the elastic body 40 can be avoided in a soldering step while the incorporation target apparatus is not lowered in appearance.

(7) The waterproof connector 30 is formed with the two-layer holes which are formed through the inside elastic portions 42 of the elastic body 40 and the base portion 32 of the housing 31. That is, the through-holes 44 and 36 through which to insert each terminal pin 50 are formed continuously in a concentric manner. The hole diameter and the length of the through-hole 44 and those of the through-hole 36 can be set independently so that the through-hole 44 can maintain waterproofness and the through-hole 36 can hold the terminal pin 50 in place.

(8) Each of the two-layer holes which are formed through the inside elastic portions 42 of the elastic body 40 and the base portion 32 of the housing 31 has such a structure that the insertion-side end portion of the terminal pin 50 which is inserted from the side of the through-hole 44 of the inside elastic portion 42 is engaged with and held by the through-hole 36 of the base portion 32, and that deformation of the inside elastic portion 42 is suppressed by the top surface of the base portion 32 of the housing 31 and the inner circumferential wall portion 35 of the terminal holding portion 33. With this measure, the positioning accuracy of the terminal pins 50 can be increased and sufficient waterproofness of the terminal pins 50 can be secured by the inside elastic portions 42.

(9) Since the bottom surface of the insulative housing 31 is formed with the grooves 37 which extend from the bottom-side opening portions of the through-holes 36 which are wider than the insertion-side end portions of the terminal pins 50 to the side surfaces of the base portion 32, gases that are generated when the terminal pins 50 are soldered to the board 60 of the incorporation target apparatus can be ejected to the outside through the grooves 37. Thus, the insulative housing 31 and the terminal pins 50 can be prevented from lifting up from the board 60 of the incorporation target apparatus. Accordingly, it is possible to avoid an event that differences occur in the heights of the top surfaces of the heads 51 of the plural terminal pins 50.

Although the present invention has been described above referring to the embodiment as an example, it would be understood by those skilled in the art that various modifications can be added to the constituent elements and processing steps in the embodiment An example modification will be described below.

The shape of the terminal pins can be modified as appropriate, and the inner diameter and the length of the housing-side through-holes and those of the through-holes of the inside elastic portions can be set accordingly.

DESCRIPTION OF SYMBOLS

10, 20, 30: Waterproof connector
15, 70: Outside mounting body
31: Insulative housing
32: Base portion
33: Terminal holding portion
34: Stepped cylindrical recess
34*a*, 36*a*: Step portion
35: Inner circumferential wall portion
36: Through-hole
37: Groove
38: Tunnel
40: Insulative elastic body
41: Outside elastic portion
42: Inside elastic portion
44: Through-hole
45: Link portion
50: Terminal pin
51: Disc-shaped head
52: Cylindrical portion
53: Waterproof ring-shaped projection
54: Coming-off preventive ring-shaped projection
60: Board

The invention claimed is:

1. A waterproof connector comprising:
an insulative housing;
an insulative elastic body held by the housing; and
a terminal pin which penetrates through the elastic body and which is held by the housing,
wherein the insulative elastic body includes an inside elastic portion and an outside elastic portion which are partitioned by the housing to each other, a link portion which links the inside elastic portion and the outside elastic portion to each other, and the inside elastic portion is surrounded by the outside elastic portion, and
wherein the housing includes a wall portion with which the inside elastic portion through which the terminal pin penetrates is in contact in a compressed state.

2. The waterproof connector according to claim 1, wherein the wall portion is formed so as to surround an entire circumference of the terminal pin.

3. The waterproof connector according to claim 1, wherein the housing includes a tunnel in a portion where the insulative elastic body is partitioned into the inside elastic portion and the outside elastic portion, and wherein the link portion is formed in the tunnel.

4. The waterproof connector according to claim 3, wherein the housing includes a base portion which supports a bottom surface of the insulative elastic body and a terminal holding portion which projects from a top surface of the base portion and partitions the insulative elastic body into the inside elastic portion and the outside elastic portion;
wherein the terminal holding portion is formed with a recess including a portion which is fitted with a head of the terminal pin and the wall portion, for each of a plurality of terminal pins, and
wherein the tunnel allows an outer circumferential surface of the terminal holding portion and the recess to communicate with each other.

5. The waterproof connector according to claim 4, wherein the base portion includes a through-hole with which an insertion end portion of the terminal pin fits, and
wherein a groove extending from the through-hole to a side surface of the base portion is formed on a bottom surface of the base portion.

6. The waterproof connector according to claim 2, wherein the housing includes a tunnel in a portion where the insulative elastic body is partitioned into the inside elastic portion and the outside elastic portion, and wherein the link portion is formed in the tunnel.

7. The waterproof connector according to claim 6, wherein the housing includes a base portion which supports a bottom surface of the insulative elastic body and a terminal holding portion which projects from a top surface of the base portion and partitions the insulative elastic body into the inside elastic portion and the outside elastic portion;
wherein the terminal holding portion is formed with a recess including a portion which is fitted with a head of the terminal pin and the wall portion, for each of a plurality of terminal pins, and
wherein the tunnel allows an outer circumferential surface of the terminal holding portion and the recess to communicate with each other.

8. The waterproof connector according to claim 7, wherein the base portion includes a through-hole with which an insertion end portion of the terminal pin fits, and
wherein a groove extending from the through-hole to a side surface of the base portion is formed on a bottom surface of the base portion.

9. The waterproof connector according to claim 1, wherein the insulative housing and the insulative elastic body are integrally formed.

10. The waterproof connector according to claim 1, wherein the terminal pin includes a cylindrical portion, and the inside elastic portion surrounds the cylindrical portion of the terminal pin.

11. The waterproof connector according to claim 2, wherein the inside elastic portion is surrounded and compressed by the wall portion.

12. The waterproof connector according to claim 3, wherein the outside elastic portion is placed on the top surface of the base portion to surround the outer circumferential surface of the terminal holding portion.

13. The waterproof connector according to claim 1, wherein the insulative elastic body is positioned at a medium position in a height direction of the insulative housing.

14. The waterproof connector according to claim 4, wherein the inside elastic portion includes a first through hole and the base portion includes a second through hole, such that the first and second through holes are configured continuously in a concentric manner, through which the terminal pin penetrates.

15. The waterproof connector according to claim 14, wherein the terminal pin includes an insertion-side end portion that is inserted through the first through hole and engaged with and held by the second through hole.

16. The waterproof connector according to claim 15, wherein the groove is wider than the insertion-side end portion of the terminal pin.

* * * * *